US009636799B2

(12) United States Patent
Liu et al.

(10) Patent No.: US 9,636,799 B2
(45) **Date of Patent: *May 2, 2017**

(54) ABRASIVE-DELIVERY APPARATUSES FOR USE WITH ABRASIVE MATERIALS IN ABRASIVE-JET SYSTEMS AND RELATED APPARATUSES, SYSTEMS, AND METHODS

(71) Applicant: OMAX Corporation, Kent, WA (US)

(72) Inventors: Peter H.-T. Liu, Bellevue, WA (US); Ernst H. Schubert, Seattle, WA (US)

(73) Assignee: OMAX Corporation, Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/728,822

(22) Filed: Jun. 2, 2015

(65) Prior Publication Data

US 2015/0336239 A1 Nov. 26, 2015

Related U.S. Application Data

(63) Continuation of application No. 14/210,017, filed on Mar. 13, 2014, now Pat. No. 9,050,704.

(60) Provisional application No. 61/801,571, filed on Mar. 15, 2013.

(51) Int. Cl.
*B24C 7/00* (2006.01)
*B24C 1/04* (2006.01)

(52) U.S. Cl.
CPC ..... *B24C 7/0015* (2013.01); *B24C 1/045* (2013.01); *B24C 7/00* (2013.01)

(58) Field of Classification Search
CPC .. B24C 1/045; B24C 5/04; B24C 7/00; B24C 7/0015
See application file for complete search history.

(56) References Cited

U.S. PATENT DOCUMENTS

| | | | |
|---|---|---|---|
| 773,665 | A | 11/1904 | Murray |
| 3,201,901 | A | 8/1965 | Pauli |
| 3,270,464 | A | 9/1966 | Bowling, Jr. et al. |
| 3,543,444 | A | 12/1970 | Mehta |

(Continued)

FOREIGN PATENT DOCUMENTS

GB 2198975 A 6/1988

OTHER PUBLICATIONS

Operation Manual, Abrasive Delivery System, Type ADS-24-II, © Flow Europe GmbH Jul. 2000, 28 pages.

*Primary Examiner* — Dung Van Nguyen
(74) *Attorney, Agent, or Firm* — Perkins Coie LLP

(57) ABSTRACT

Abrasive-delivery apparatuses for use in abrasive-jet systems and associated apparatuses, systems, and methods are disclosed. An abrasive-delivery apparatus configured in accordance with a particular embodiment includes a first funnel segment and a second funnel segment downstream from the first funnel segment. The first funnel segment can have a first inlet, a first outlet, and a first interior region extending between the first inlet and the first outlet. Similarly, the second funnel segment can have a second inlet, a second outlet, and a second interior region extending between the second inlet and the second outlet. The first interior region can have a first inward taper toward the first outlet, and the second interior region can have a second inward taper toward the second outlet. The second inward taper can be steeper than the first inward taper when the abrasive-delivery apparatus is vertically oriented.

12 Claims, 6 Drawing Sheets

(56) References Cited

U.S. PATENT DOCUMENTS

| | | | | |
|---|---|---|---|---|
| 3,834,082 | A | 9/1974 | Grudzinski | |
| 4,815,241 | A | 3/1989 | Woodson et al. | |
| 4,984,397 | A | 1/1991 | Van Leeuwen et al. | |
| 4,993,200 | A | 2/1991 | Morioka et al. | |
| 5,098,229 | A | 3/1992 | Meier et al. | |
| 5,107,630 | A | 4/1992 | Lodewijk | |
| 5,201,150 | A | 4/1993 | Kuboyama et al. | |
| 5,363,556 | A | 11/1994 | Banholzer et al. | |
| 5,421,766 | A | 6/1995 | Shank, Jr. et al. | |
| 5,468,066 | A | 11/1995 | Hammonds | |
| 5,643,058 | A | 7/1997 | Erichsen et al. | |
| 6,083,001 | A | 7/2000 | Deardon et al. | |
| 6,098,677 | A | 8/2000 | Wegman et al. | |
| 6,168,503 | B1 | 1/2001 | Pao et al. | |
| 6,200,203 | B1 * | 3/2001 | Xu | B24C 1/045 451/100 |
| 6,283,833 | B1 | 9/2001 | Pao et al. | |
| 6,390,898 | B1 | 5/2002 | Pieper | |
| 6,425,804 | B1 | 7/2002 | Pettit et al. | |
| 7,108,585 | B1 | 9/2006 | Dorfman et al. | |
| 7,980,923 | B2 * | 7/2011 | Olmo | A61C 3/025 433/215 |
| 8,342,912 | B2 | 1/2013 | Funatsu et al. | |
| 8,920,213 | B2 | 12/2014 | Liu et al. | |
| 9,050,704 | B1 * | 6/2015 | Liu | B24C 1/045 |
| 9,090,808 | B1 | 7/2015 | Liu et al. | |
| 2012/0021676 | A1 | 1/2012 | Schubert et al. | |
| 2012/0156969 | A1 | 6/2012 | Liu | |
| 2012/0196516 | A1 | 8/2012 | Funatsu et al. | |
| 2012/0252326 | A1 | 10/2012 | Schubert et al. | |
| 2013/0005225 | A1 | 1/2013 | Russo | |
| 2013/0267152 | A1 | 10/2013 | Tera et al. | |

* cited by examiner

ABRASIVE-DELIVERY APPARATUSES FOR USE WITH ABRASIVE MATERIALS IN ABRASIVE-JET SYSTEMS AND RELATED APPARATUSES, SYSTEMS, AND METHODS

CROSS-REFERENCE TO RELATED APPLICATION

This application is a continuation of U.S. application Ser. No. 14/210,017, filed Mar. 13, 2014, now issued as U.S. Pat. No. 9,050,704, which application claims the benefit of U.S. Provisional Application No. 61/801,571, filed Mar. 15, 2013. The foregoing applications are incorporated herein by reference in their entireties. To the extent the foregoing applications or any other material incorporated herein by reference conflicts with the present disclosure, the present disclosure controls.

ACKNOWLEDGEMENT OF GOVERNMENT SUPPORT

This invention was made in part using funds provided by the National Science Foundation Grant Nos. 0944239 and 1058278. The United States Government may have certain rights in this invention.

TECHNICAL FIELD

This disclosure relates to abrasive-delivery apparatuses for use with abrasive materials in abrasive-jet systems and related apparatuses, systems, and methods.

BACKGROUND

Abrasive-jet systems are used in precision cutting, shaping, carving, reaming, and other material-processing applications. During operation, abrasive-jet systems typically direct a high-speed jet of fluid (e.g., water) toward a workpiece to rapidly erode portions of the workpiece. Abrasive material can be added to the fluid to increase the rate of erosion. When compared to other material-processing systems (e.g., grinding systems, plasma-cutting systems, etc.), abrasive-jet systems can have significant advantages. For example, abrasive-jet systems often produce relatively fine and clean cuts, typically without heat-affected zones around the cuts. Abrasive-jet systems also tend to be highly versatile with respect to the material type of the workpiece. The range of materials that can be processed using abrasive-jet systems includes very soft materials (e.g., rubber, foam, leather, and paper) as well as very hard materials (e.g., stone, ceramic, and hardened metal). Furthermore, in many cases, abrasive-jet systems can execute demanding material-processing operations while generating little or no dust or smoke.

In a typical abrasive-jet system, a pump pressurizes a fluid to a high pressure (e.g., 275 meganewtons/square meter (40,000 pounds/square inch) to 689 meganewtons/square meter (100,000 pounds/square inch) or more). Some of this pressurized fluid is routed through a cutting head that includes an orifice element having an orifice. Passing through the orifice converts static pressure of the fluid into kinetic energy, which causes the fluid to exit the cutting head as a jet at high speed (e.g., up to 762 meters/second (2,500 feet/second) or more) and impact a workpiece. The orifice element can be a hard jewel (e.g., a synthetic sapphire, ruby, or diamond) held in a suitable mount. In many cases, a jig supports the workpiece. The jig, the cutting head, or both can be movable under computer or robotic control such that complex processing instructions can be executed automatically.

Some conventional abrasive-jet systems mix abrasive material and fluid to form slurry before forming the slurry into a jet. This approach can simplify achieving consistent and reliable incorporation of the abrasive material into the jet, but can also cause excessive wear on internal system components as the slurry is pressurized and then formed into the jet. In an alternative approach, abrasive material is mixed with a fluid after the fluid is formed into a jet (e.g., after the fluid passes through an orifice). In this approach, the Venturi effect associated with the jet can draw the abrasive material into a mixing region along a flow path of the jet. When executed properly, this manner of incorporating abrasive material into a jet can be at least partially self-metering. For example, replenishment of abrasive material in the mixing region can automatically match consumption of abrasive material in the mixing region. The equilibrium between replenishment and consumption, however, can be sensitive to variations in the source of the abrasive material upstream from the mixing region. In at least some cases, conventional apparatuses that convey abrasive materials within abrasive-jet systems insufficiently facilitate consistent and reliable delivery of abrasive materials to cutting heads. This can lead to variability in incorporation of the abrasive materials into fluid jets passing through the cutting heads, which, in turn, can cause skip cutting in metals, cracking and chipping in glass, delamination in composites, and/or other undesirable material-processing outcomes.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical or at least generally similar or analogous components or features.

DETAILED DESCRIPTION

Figure 1:
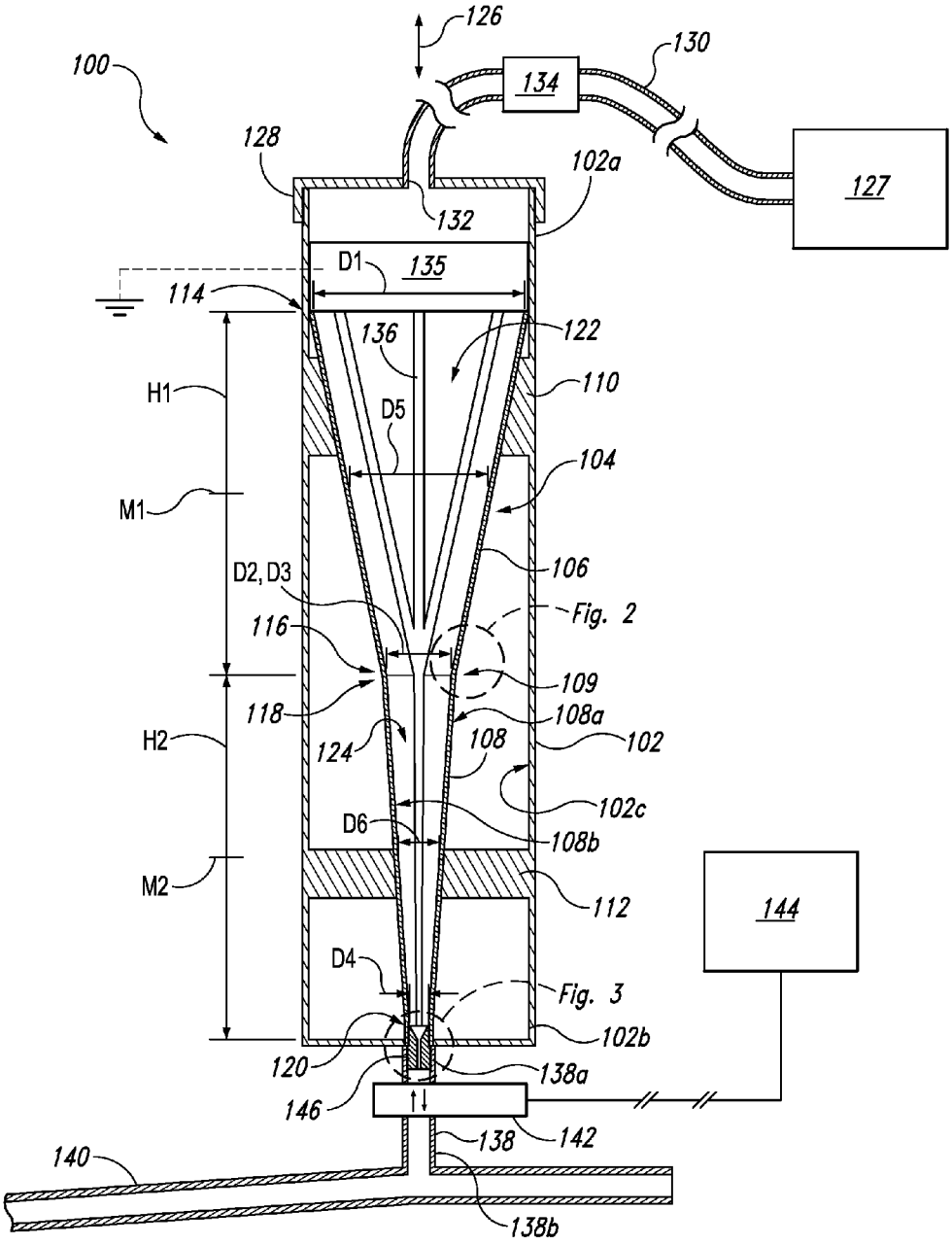
FIG. 1 is a side cross-sectional view illustrating an abrasive-delivery apparatus configured in accordance with an embodiment of the present technology.

Specific details of several embodiments of the present technology are disclosed herein with reference to FIGS. 1-7. Although the embodiments are disclosed herein primarily or entirely with respect to abrasive-jet applications, other applications are within the scope of the present technology. For example, abrasive-delivery apparatuses configured in accordance with at least some embodiments of the present technology can be useful in gas-entrained particle blasting applications. Abrasive-jet systems described herein can be used with a variety of suitable fluids, such as water, aqueous solutions, hydrocarbons, glycol, and liquid nitrogen, among others. As such, although the term "waterjet" may be used herein for ease of reference, unless the context clearly indicates otherwise, the term refers to a fluid jet formed by any suitable fluid, and is not limited exclusively to water or aqueous solutions. It should be noted that other embodiments in addition to those disclosed herein are within the scope of the present technology. For example, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

In many applications, the diameter of a fluid jet may be relatively small (e.g., from about 76 microns (0.003 inch) to about 250 microns (0.01 inch)). This can be the case, for example, in abrasive-jet systems configured for material-processing operations on a small scale (e.g., micromachining applications, among others). A small-diameter fluid jet typically produces a relatively weak Venturi effect. The same can be true for relatively low-speed fluid jets (e.g., a low-speed fluid jet produced by reducing fluid pressure upstream from a jet orifice, such as to facilitate piercing delicate materials). A relatively weak Venturi effect can complicate consistent and reliable incorporation of an abrasive material into a fluid jet. Vacuum assistance can be used to at least partially address this problem. For example, a vacuum generating device can be operably connected to a cutting head in an abrasive-jet system via a vacuum line and used to provide negative pressure to the cutting head so as to supplement a relatively weak Venturi effect. Vacuum assistance, however, can be challenging to control. For example, vacuum assistance can interfere with equilibrium between replenishment and consumption of abrasive material within a mixing region of a cutting head, leading to inconsistent incorporation of the abrasive material into a fluid jet passing through the cutting head. Furthermore, vacuum generating devices tend to be bulky and vacuum lines extending between such devices and cutting heads can undesirably restrict movement of the cutting heads (e.g., relative to workpieces).

When producing small-diameter fluid jets, low-speed fluid jets, and in other applications, it is often advantageous (or even necessary in some cases) to use fine particulate abrasive materials. For example, in an abrasive-jet system including a cutting head configured to produce a small-diameter fluid jet, abrasive particles of a suitable abrasive material can have an average sieve diameter less than about 40% (e.g., less than about 35%, less than about 30%, or below another suitable threshold percentage) of an inner diameter of an exit tube downstream from a mixing region within the cutting head. Such abrasive particles can reduce or prevent clogging (e.g., due to bridging of abrasive particles within the cutting head). The use of fine particulate abrasive materials can also be necessary or desirable in other applications, such as applications that call for reduced surface roughness around a cut. Unfortunately, fine particulate abrasive materials, alone or in conjunction with small-diameter and/or low-speed fluid jets, can be more challenging to consistently and reliably convey to a cutting head than coarse particulate abrasive materials. Many undesirable flow characteristics (e.g., clumping and rat-hole formation, among others) tend to be more pronounced with fine particulate abrasive materials than with coarse particulate abrasive materials. By way of theory, and not to limit the scope of the present disclosure, at least some undesirable flow characteristics of conventional particulate abrasive materials may be related to friction between constituent abrasive particles. This particle-to-particle friction can have proportionally more influence on the behavior of particulate abrasive materials as the size of the abrasive particles decreases. Thus, in abrasive-jet systems having miniature exit tubes and/or abrasive-jet systems in which the use of fine particulate abrasive materials is otherwise necessary or desirable, feeding such abrasive materials consistently and reliably to a cutting head can be technically challenging.

Abrasive-delivery apparatuses configured in accordance with at least some embodiments of the present technology can at least partially overcome one or more of the disadvantages and technical challenges discussed above and/or one or more other disadvantages and/or technical challenges associated with conventional abrasive-jet technology. For example, abrasive-delivery apparatuses configured in accordance with at least some embodiments of the present technology can have one or more shapes, angles, other geometrical features, and/or other non-geometrical features that enhance the consistency and/or reliability of flowing fine particulate abrasive materials by gravity relative to at least some conventional abrasive-delivery apparatuses. This can reduce or eliminate the need for vacuum assistance. In a particular example, an abrasive-delivery apparatus configured in accordance with an embodiment of the present technology includes multiple funnel segments (e.g., two, three, four or a greater number of funnel segments) having successively steeper tapers along a downward path along which abrasive material flows by gravity. In at least some cases, particulate abrasive materials (e.g., fine particulate abrasive materials) can flow more consistently, more reliably, and/or at a faster rate through the abrasive-delivery apparatus than through abrasive-delivery apparatuses having only one funnel segment. Furthermore, instead of or in addition to this advantage, the abrasive-delivery apparatus can have other advantages relative to conventional abrasive-delivery apparatuses. Such advantages, for example, may apply to the use of fine particulate abrasive materials and/or to the use of coarse particulate abrasive materials.

Fine particulate abrasive materials can include abrasive particles having an average sieve diameter, for example, of about 50 microns (1969 microinches) or less (e.g., within a range from about 5 microns (197 microinches) to about 50 microns (1969 microinches), within a range from about 5 microns (197 microinches) to about 35 microns (1378 microinches), within a range from about 5 microns (197 microinches) to about 25 microns (984 microinches), or within another suitable range). Coarse particulate abrasive materials can include abrasive particles having an average sieve diameter, for example, of about 50 microns (1969 microinches) or more (e.g., within a range from about 50 microns (1969 microinches) to about 150 microns (5906 microinches), within a range from about 50 microns (1969 microinches) to about 100 microns (3937 microinches), within a range from about 50 microns (1969 microinches) to about 75 microns (2953 microinches), or within another suitable range). Abrasive-delivery apparatuses configured in accordance at least some embodiments of the present technology can be well suited for use with relatively fine abrasive particles and/or relatively coarse abrasive particles. Furthermore, abrasive-delivery apparatuses configured in accordance with at least some embodiments of the present technology can be configured for use with coated and/or uncoated abrasive particles. Additional details regarding suitable abrasive materials are included in U.S. Provisional Patent Application No. 61/801,823, filed Mar. 15, 2013, which is incorporated herein by reference in its entirety.

FIG. 1 is a side cross-sectional view illustrating an abrasive-delivery apparatus 100 configured in accordance with an embodiment of the present technology. The abrasive-delivery apparatus 100 can include a funnel 104 operably disposed within a cylindrical housing 102. In operation, the abrasive-delivery apparatus 100 can be configured to be vertically oriented as shown in FIG. 1. When vertically oriented, the abrasive-delivery apparatus 100 can receive particulate abrasive material (not shown) through an upper end portion 102*a* of the housing 102, and to dispense particulate abrasive material (e.g., by gravity) through a lower end portion 102*b* of the housing 102. The funnel 104 can include a first funnel segment 106 (e.g., a funnel body), a second funnel segment 108 (e.g., a funnel stem), and a junction 109 therebetween. The second funnel segment 108 can be downstream from the first funnel segment 106 and further from the upper end portion 102*a* of the housing 102 than the first funnel segment 106. In at least some cases, one or more features of the abrasive-delivery apparatus 100 may reduce or prevent certain undesirable abrasive-particle behavior, such as rat-hole formation, among other types of behavior.

The abrasive-delivery apparatus 100 can further include a first support member 110 within the housing 102 configured to at least partially support the funnel 104 by contacting the first funnel segment 106, and a second support member 112 within the housing 102 configured to at least partially support the funnel 104 by contacting the second funnel segment 108. In some embodiments, the first and second support members 110, 112 are configured to prevent or reduce lateral and downward movement of the funnel 104 relative to the housing 102, but to allow upward movement of the funnel 104 relative to the housing 102, such as to allow the funnel 104 to be removed from the housing 102 upwardly for servicing and/or replacement. The first support member 110 can be a single annular element or a group of two or more separate bridging elements circumferentially spaced apart and extending radially from an outer surface 106*a* of the first funnel segment 106 to an inner surface 102*c* of the housing 102. Similarly, the second support member 112 can be a single annular element or a group of two or more separate bridging elements circumferentially spaced apart and extending radially from an outer surface 108*a* of the second funnel segment 108 to the inner surface 102*c* of the housing 102. In some embodiments, the first and second support members 110, 112 are secured (e.g., fixedly or detachably secured) to the inner surface 102*c* of the housing 102 and not secured (e.g., releasably abutting) the outer surfaces 106*a*, 108*a*, respectively, of the first and second funnel segments 106, 108, respectively.

The first funnel segment 106 can include a first inlet 114 and a first outlet 116. The first outlet 116 can be downstream from the first inlet 114 and further from the upper end portion 102*a* of the housing 102 than the first inlet 114. Similarly, the second funnel segment 108 can include a second inlet 118 and a second outlet 120. The second outlet 120 can be downstream from the second inlet 118 and further from the upper end portion 102*a* of the housing 102 than the second inlet 118. A first interior region 122 of the first funnel segment 106 can extend between the first inlet 114 and the first outlet 116, and a second interior region 124 of the second funnel segment 108 can extend between the second inlet 118 and the second outlet 120. The first and second interior regions 122, 124 can be inwardly tapered (e.g., monotonically tapered) in a direction extending from the upper end portion 102*a* of the housing 102 toward the lower end portion 102*b* of the housing 102. Due to the taper of the first interior region 122, a cross-sectional area and a diameter (D1) of the first inlet 114 perpendicular to a vertical axis 126 is greater than a cross-sectional area and a diameter (D2) of the first outlet 116 perpendicular to the vertical axis 126. Similarly, due to the taper of the second interior region 124, a cross-sectional area and a diameter (D3) of the second inlet 118 perpendicular to the vertical axis 126 is greater than a cross-sectional area and a diameter (D4) of the second outlet 120 perpendicular to the vertical axis 126. In some embodiments, D2 is equal to D3. In other embodiments, D2 is not equal to D3, such as to form a step or overhang at the junction 109. Furthermore, the transition can be rounded to provide a smooth transition from the from the interior surface 106*b* of the first funnel segment 106 to the interior surface 108*b* of the second funnel segment 108 at the junction 109.

One or more aspects of the geometry of the first and second interior regions 122, 124 can be selected to enhance the consistency and/or reliability of flowing fine particulate abrasive material under gravity. In some embodiments, the first interior region 122 has a first inward taper toward the first outlet 116, the second interior region 124 has a second inward taper toward the second outlet 120, and the second inward taper is steeper than the first inward taper when the abrasive-delivery apparatus 100 is vertically oriented. The first interior region 122 can have a height H1 along the vertical axis 126 and a diameter (D5) perpendicular to the vertical axis 126 at a midpoint (M1) along H1 between the first inlet 114 and the first outlet 116 when the abrasive-delivery apparatus 100 is vertically oriented. In some embodiments, H1 is at least about one times D5. In other embodiments, H1 can have another suitable value relative to D5. The second interior region 124 can have a height H2 along the vertical axis 126 and a diameter (D6) perpendicular to the vertical axis 126 at a midpoint (M2) along H2 between the second inlet 118 and the second outlet 120 when the abrasive-delivery apparatus 100 is vertically oriented. In some embodiments, H2 is at least about two times D6. In other embodiments, H2 can have another suitable value relative to D6.

Figure 2:
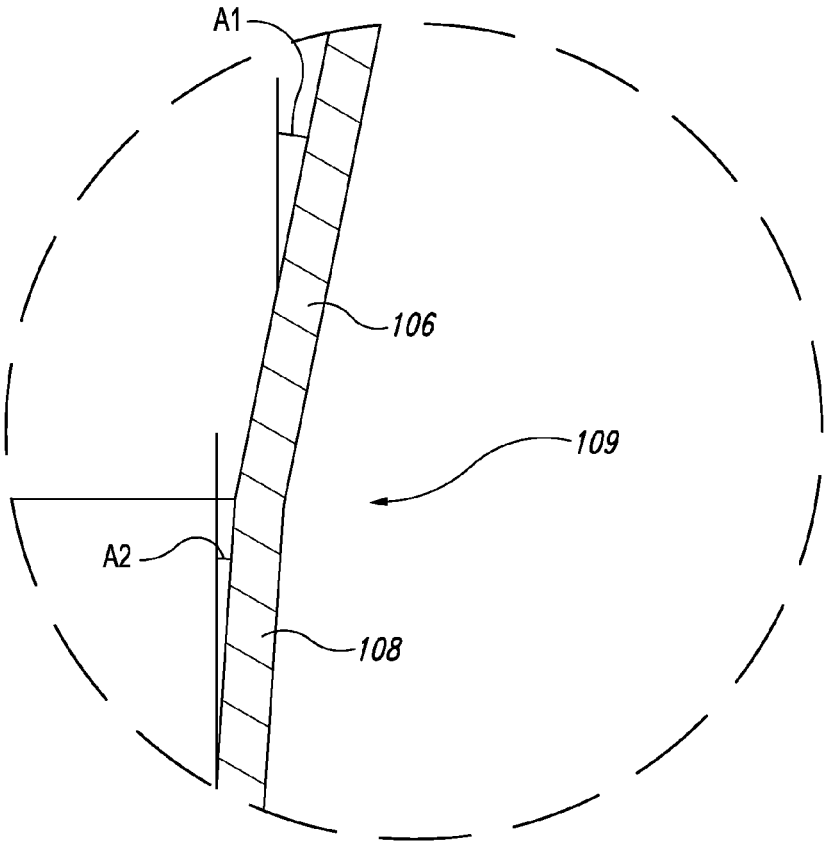
FIG. 2 is an enlarged cross-sectional side view illustrating a junction between a first funnel segment and a second funnel segment of the abrasive-delivery apparatus shown in FIG. 1.

FIG. 2 is an enlarged cross-sectional side view illustrating the junction 109 between the first funnel segment 106 and the second funnel segment 108. With reference to FIGS. 1 and 2 together, the first funnel segment 106 (e.g., at least a portion of an interior surface 106*b* of the first funnel segment 106 at the first interior region 122) can have a first interior angle (A1) off vertical when the abrasive-delivery apparatus 100 is vertically oriented. Similarly, the second funnel segment 108 (e.g., at least a portion of an interior surface 108*b* of the second funnel segment 108 at the second interior region 124) can have a second interior angle (A2) off vertical when the abrasive-delivery apparatus 100 is vertically oriented. In some embodiments, A2 is a percentage of A1 within a range from about 20% to about 40%, a range from about 25% to about 35%, or another suitable range. In a particular embodiment, A1 is about 30% of A2. A1 can be within a range from about 7 degrees to about 24 degrees off vertical, a range from about 7 degrees to about 20 degrees off vertical, a range from about 7 degrees to about 16 degrees off vertical, or another suitable range when the abrasive-delivery apparatus 100 is vertically oriented. In a particular embodiment, A1 is about 11.5 degrees. A2 can be within a range from about 2 degrees to about 9 degrees off vertical, a range from about 2 degrees to about 7 degrees off vertical, a range from about 2 degrees to about 5 degrees off vertical, or another suitable range when the abrasive-delivery apparatus 100 is vertically oriented. In a particular embodiment, A2 is about 3.5 degrees. The transition from the first taper to the second taper at the junction 109 can be abrupt or gradual. Furthermore, the first and second tapers can be consistent or varying along H1 and H2, respectively.

Referring to FIG. 1, upstream from the housing 102, the abrasive-delivery apparatus 100 can include an abrasive source 127 and an inlet conduit 130 extending between the abrasive source 127 and the upper end portion 102*a* of the housing 102. The housing 102 can include a cover 128 (e.g., a detachable cap) at the upper end portion 102*a*, and the inlet conduit 130 can extend through an opening 132 in the cover 128. In some embodiments, a pump 134 or another suitable conveyance mechanism is operably connected to the inlet conduit 130 (e.g., upstream or downstream of the abrasive source 127) and configured to move particulate abrasive material from the abrasive source 127 to the housing 102. In other embodiments, the housing 102 can be configured to be manually supplied with particulate abrasive material or configured to be automatically supplied with particulate abrasive material by another suitable mechanism. Flow of particulate abrasive material from the abrasive source 127 to the housing 102. Within the housing 102, downstream from the opening 132 and upstream from the first funnel segment 106, the abrasive-delivery apparatus 100 can include a filter 135 (shown schematically). The filter 135 can be configured to prevent particulate abrasive material and/or foreign matter having a sieve diameter greater than a threshold sieve diameter from entering the first funnel segment 106. The abrasive-delivery apparatus 100 can also include a static electricity collector 136 configured to reduce the buildup of static electricity within the abrasive-delivery apparatus 100. Static electricity can detrimentally affect the flow characteristics of particulate abrasive materials, such as fine and/or coated particulate abrasive materials. The first and second funnel segments 106, 108 can be electrically insulative and the static electricity collector 136 can be electrically conductive. As shown in FIG. 1, the static electricity collector 136 can include a network of strips of exposed metal coupled to the interior surfaces 106*b*, 108*b* of the first and second funnel segments 106, 108. In some embodiments, the strips of exposed metal are electrically grounded via the filter 135. In other embodiments, the strips of exposed metal can be electrically grounded in another suitable manner.

Downstream from the housing 102, the abrasive-delivery apparatus 100 can include an outlet conduit 138 extending vertically from the lower end portion 102*b* of the housing 102 to an abrasive-delivery conduit 140 extending between the abrasive-delivery apparatus 100 and a cutting head (not shown). The outlet conduit 138, for example, can be vertically oriented and can include an upper portion 138*a* at the lower end portion 102*b* of the housing 102 to a lower portion at abrasive-delivery conduit 140 when the abrasive-delivery apparatus 100 is vertically oriented. In some embodiments, the abrasive-delivery conduit 140 is slanted downward from the outlet conduit 138 toward the cutting head, such as to facilitate flow of particulate abrasive material by gravity. The abrasive-delivery apparatus 100 can further include a shutoff valve 142 operably connected to the outlet conduit 138 between the upper and lower portions 138*a*, 138*b* of the outlet conduit 138. The shutoff valve 142 can be configured to start or stop the flow of particulate abrasive material into the abrasive-delivery conduit 140 as needed (e.g., in concert with operation of the cutting head). In some embodiments, the shutoff valve 142 is pneumatic and operably connected to a pneumatic source 144. In other embodiments, the shutoff valve 142 can be electric, manual, or be configured to operate in accordance with another suitable modality.

Figure 3:
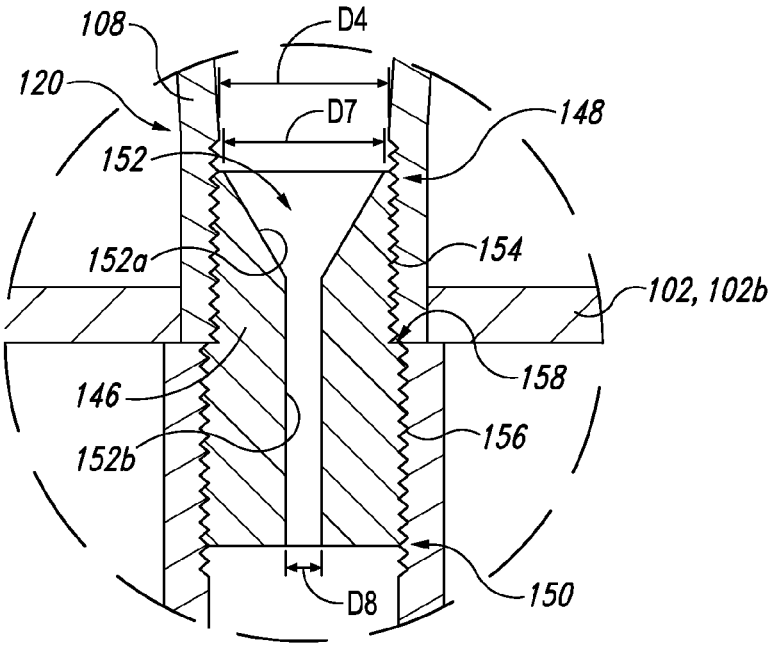
FIG. 3 is an enlarged cross-sectional side view illustrating a metering element of the abrasive-delivery apparatus shown in FIG. 1 configured in accordance with an embodiment of the present technology.

FIG. 3 is an enlarged cross-sectional side view illustrating a metering element 146 of the abrasive-delivery apparatus 100. The metering element 146 can include a third inlet 148 and a third outlet 150. The third outlet 150 can be configured to be downstream from the third inlet 148 and further from the upper end portion 102*a* of the housing 102 than the third inlet 148. A third interior region 152 of the metering element 146 can extend between the third inlet 148 and the third outlet 150. The third interior region 152 can include an entry portion 152*a* (e.g., an entry cone) at the third inlet 148 and an exit portion 152*b* (e.g., a straight bore) at the third outlet 150. The metering element 146 at the entry portion 152*a* can have a third inward taper in a direction extending from the third inlet 148 to the third outlet 150. For example, when the abrasive-delivery apparatus 100 is vertically oriented and the metering element 146 is connected to the second funnel segment 108, a cross-sectional area and a diameter (D7) of the third inlet 148 perpendicular to the vertical axis 126 can be greater than a cross-sectional area and a diameter (D8) of the third outlet 150 perpendicular to the vertical axis 126. In some cases, D8 at least partially governs the flow rate of abrasive material through the metering element 146. Furthermore, when the abrasive-delivery apparatus 100 is vertically oriented and the metering element 146 is connected to the second funnel segment 108, the metering element 146 can have an interior angle at the entry portion 152*a*, for example, within a range from about 15 degrees to about 45 degrees off vertical, a range from about 20 degrees to about 40 degrees off vertical, a range from about 25 degrees to about 35 degrees off vertical, or another suitable range. In a particular embodiment, the metering element 146 has an interior angle of about 30 degrees off vertical at the entry portion 152*a*. In another embodiment (e.g., for use with coated fine abrasive material) the metering element 146 has an interior angle of about 90 degrees off vertical at the entry portion 152*a*.

In some embodiments, the metering element 146 is detachably connectable to the second funnel segment 108 and/or to the outlet conduit 138. For example, the metering element 146 and the second funnel segment 108 can include first complementary threads 154 at the second outlet 120, and the metering element 146 and the outlet conduit 138 can include second complementary threads 156 at the upper portion 138*a* of the outlet conduit 138. The diameter of the metering element 146 can be stepped down to form a lip 158 between the first and second complementary threads 154, 156 that is configured to abut an edge of the second outlet 120 when the first complementary threads 154 are fully engaged. The metering element 146 can be detached from the second funnel segment 108, for example, to allow substitution of a separate metering element (not shown) having a different D8 value. For example, the metering element 146 can be one of a set of metering elements (not shown) having different D8 values, such that different members of the set cause different flow rates of particulate abrasive material by gravity. In other embodiments, the metering element 146 can be fixedly connected to the second funnel segment 108. Furthermore, when detachable, the metering element 146 can be configured to detachably connect to the second funnel segment 108 and/or to the outlet conduit 138 by another suitable type of detachable coupling.

Figure 4:
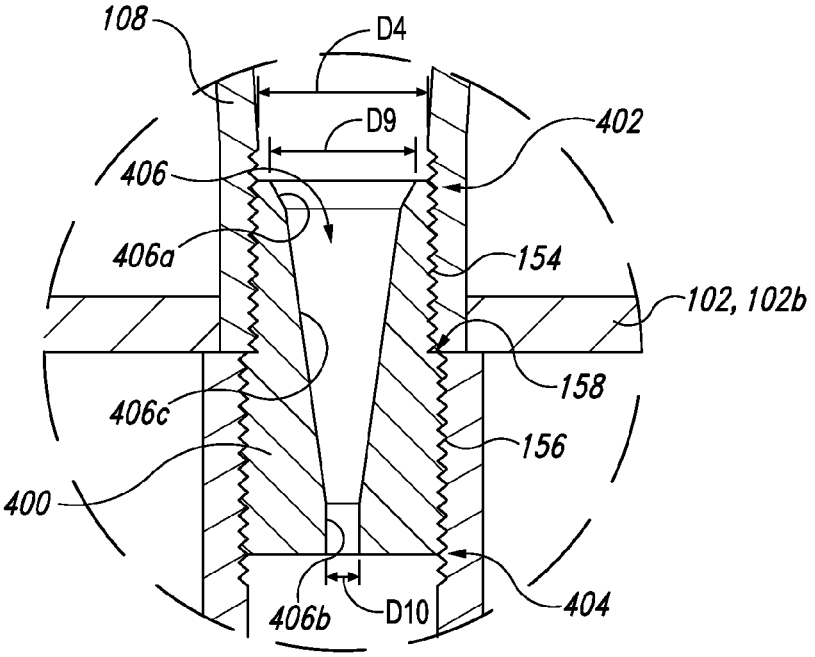
FIG. 4 is an enlarged cross-sectional side view illustrating a metering element configured in accordance with another embodiment of the present technology.

FIG. 4 is an enlarged cross-sectional side view illustrating a metering element 400 configured in accordance with another embodiment of the present technology. The metering element 400 can include a third inlet 402 and a third outlet 404. The third outlet 404 can be downstream from the third inlet 402 and further from the upper end portion 102*a* of the housing 102 than the third inlet 402. A third interior region 406 of the metering element 400 can extend between the third inlet 402 and the third outlet 404. The third interior region 406 can include an entry portion 406*a* (e.g., an entry cone) at the third inlet 402, an exit portion 406*b* (e.g., a straight bore) at the third outlet 404, and an intervening portion 406*c* (e.g., a transition cone) therebetween. The intervening portion 406*c* and the entry portion 406*a* can have a third inward taper and a fourth inward taper, respectively, in a direction extending from the third inlet 402 to the third outlet 404. For example, when the abrasive-delivery apparatus 100 is vertically oriented and the metering element 400 is detachably connected to the second funnel segment 108, a cross-sectional area and a diameter (D9) of the third inlet 402 perpendicular to the vertical axis 126 can be greater than a cross-sectional area and a diameter (D10) of the third outlet 404 perpendicular to the vertical axis 126. In some cases, D10 at least partially governs the flow rate of abrasive material through the metering element 400. Furthermore, when the abrasive-delivery apparatus 100 is vertically oriented and the metering element 400 is detachably connected to the second funnel segment 108, the third inward taper can be steeper than the fourth inward taper. The metering element 400 can have an interior angle at the entry portion 406*a*, for example, within a range from about 4 degrees to about 12 degrees off vertical, a range from about 6 degrees to about 10 degrees off vertical, a range from about 7 degrees to about 9 degrees off vertical, or another suitable range when the abrasive-delivery apparatus 100 is vertically oriented and the metering element 400 is detachably connected to the second funnel segment 108. In a particular embodiment, the metering element 146 has an interior angle of about 8 degrees off vertical at the entry portion 406*a*.

One or more aspects of the geometry of the metering elements 146, 400 can enhance the consistency and/or reliability of flowing particulate abrasive material in response to gravity. For example, the ratio of D4 to D8, the ratio of D4 to D10, the interior angle of the third interior regions 152, 406 (e.g., at the entry portions 152*a*, 406*a* and/or at the intervening portion 406*c*), and/or one or more other geometrical or other features of the metering elements 146, 400 can be selected to affect the flow characteristics of fine and/or coarse particulate abrasive materials. These geometrical or other features of the metering elements 146, 400 may affect fine and coarse particulate abrasive materials in a similar manner or differently. For example, in at least some cases, with respect to both fine and coarse particulate abrasive materials, it can be advantageous for the ratio of D4 to D8 and the ratio of D4 to D10 to be about 3:1 or greater (e.g., from about 3:1 to about 20:1), about 4:1 or greater (e.g., from about 4:1 to about 20:1), or greater than another suitable threshold value. By way of theory, and not to limit the scope of the present technology, this may reduce or prevent voids from developing within the third interior regions 152, 406, which may detrimentally affect the stability of flow of particulate abrasive materials (e.g., fine and/or coated particulate abrasive materials) through the third interior regions 152, 406. In some cases, the intervening portion 406*c* of the third interior region 406 may be better suited for enhancing the flow characteristics of coarse particulate abrasive materials than for enhancing the flow characteristics of fine particulate abrasive materials. Furthermore, in these and other cases, the intervening portion 406*c* of the third interior region 406 may be better suited for enhancing the flow characteristics of uncoated particulate abrasive materials than for enhancing the flow characteristics of coated particulate abrasive materials. In other cases, the intervening portion 406*c* of the third interior region 406 may have other relative compatibilities.

Figure 5:
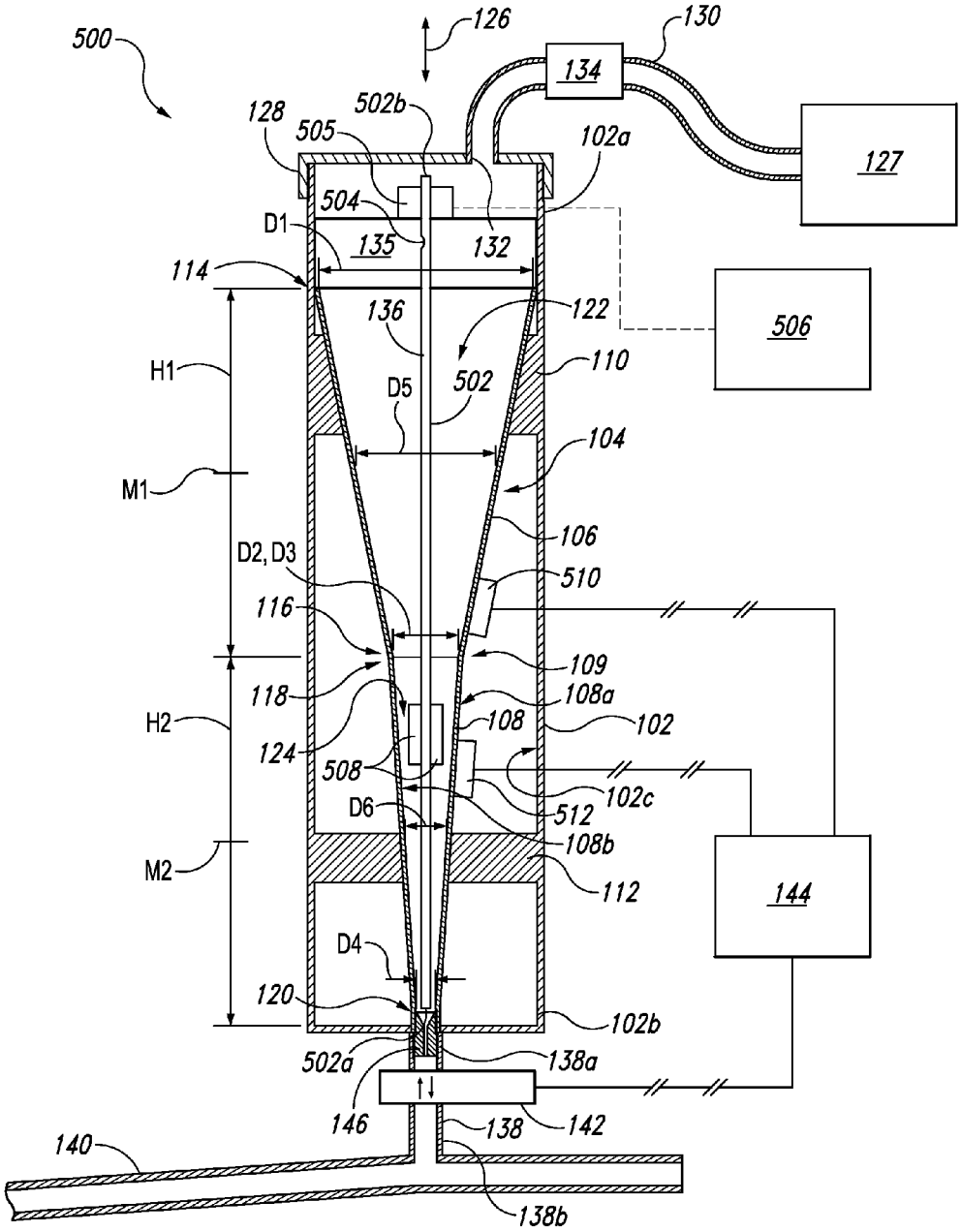
FIG. 5 is a side cross-sectional view illustrating an abrasive-delivery apparatus configured in accordance with another embodiment of the present technology.

FIG. 5 is a side cross-sectional view illustrating an abrasive-delivery apparatus 500 configured in accordance with another embodiment of the present technology. The abrasive-delivery apparatus 500 can include a ventilation tube 502 having a longitudinal axis long parallel to the vertical axis 126 when the abrasive-delivery apparatus 500 is vertically oriented. For example, the ventilation tube 502 can extend longitudinally parallel to the vertical axis 126 through the first interior region 122 from a first end 502*a* to an opposite second end 502*b*. The first end 502*a* can be positioned within the second interior region 124 slightly spaced apart from the third inlet 148 (FIG. 3). For example, a vertical spacing between the second end 502*b* and the third inlet 148 can be within a range from about 5 millimeters to about 21 millimeters, within a range from about 8 millimeters to about 17 millimeters, or within another suitable range when the abrasive-delivery apparatus 500 is vertically oriented and the metering element 146 is detachably connected to the second funnel segment 108.

The ventilation tube 502 can be configured to vent entrained gas in particulate abrasive material in the vicinity of the third inlet 148. This entrained gas may detrimentally affect the stability of flow of particulate abrasive materials (e.g., fine and/or coated particulate abrasive materials) into and/or through the metering element 146. In some embodiments, the ventilation tube 502 includes a first opening (not shown) at the first end 502*a* and a second opening 504 outside of the first and second interior regions 122, 124 (e.g., within the filter 135). In other embodiments, the first opening and/or the second opening 504 can have other suitable positions. For example, the second opening 504 can be at the second end 502*b*. In addition to or instead of conveying entrained gas from particulate abrasive material in the vicinity of the third inlet 148, the ventilation tube 502 can be electrically conductive and configured to collect static electricity generated by funneling particulate abrasive material through the first and second funnel segments 106, 108. Thus, the ventilation tube 502 can supplement or replace the functionality of the static electricity collector 136 shown in FIG. 1.

The ventilation tube 502 can be configured to rotate or otherwise move relative to the first and second funnel segments 106, 108, such as to agitate particulate abrasive material within the first and/or second interior regions 122, 124. For example, abrasive-delivery apparatus 500 can include a motor 505 operably connected to the ventilation tube 502 and configured to rotate the ventilation tube 502 about its longitudinal axis. The motor 505 can be configured to draw energy from an electrical supply 506. In some embodiments, the ventilation tube 502 includes one or more lateral projections 508 (e.g., fins) configured to stir or otherwise enhance agitation of particulate abrasive material within the first and/or second interior regions 122, 124. In other embodiments, the lateral projections 508 can be absent. Furthermore, instead of or in addition to the lateral projections 508, the abrasive-delivery apparatus 500 can include a first vibratory agitator 510 operably coupled to the first funnel segment 106 (e.g., at the outer surface 106*a*) and/or a second vibratory agitator 512 operably coupled to the second funnel segment 108 (e.g., at the outer surface 108*a*). In some embodiments, the first and second vibratory agitators 510, 512 can be pneumatic and operably connected to the pneumatic source 144. In other embodiments, the first and second vibratory agitators 510, 512 can be electric or be configured to operate in accordance with another suitable modality.

Figure 6:
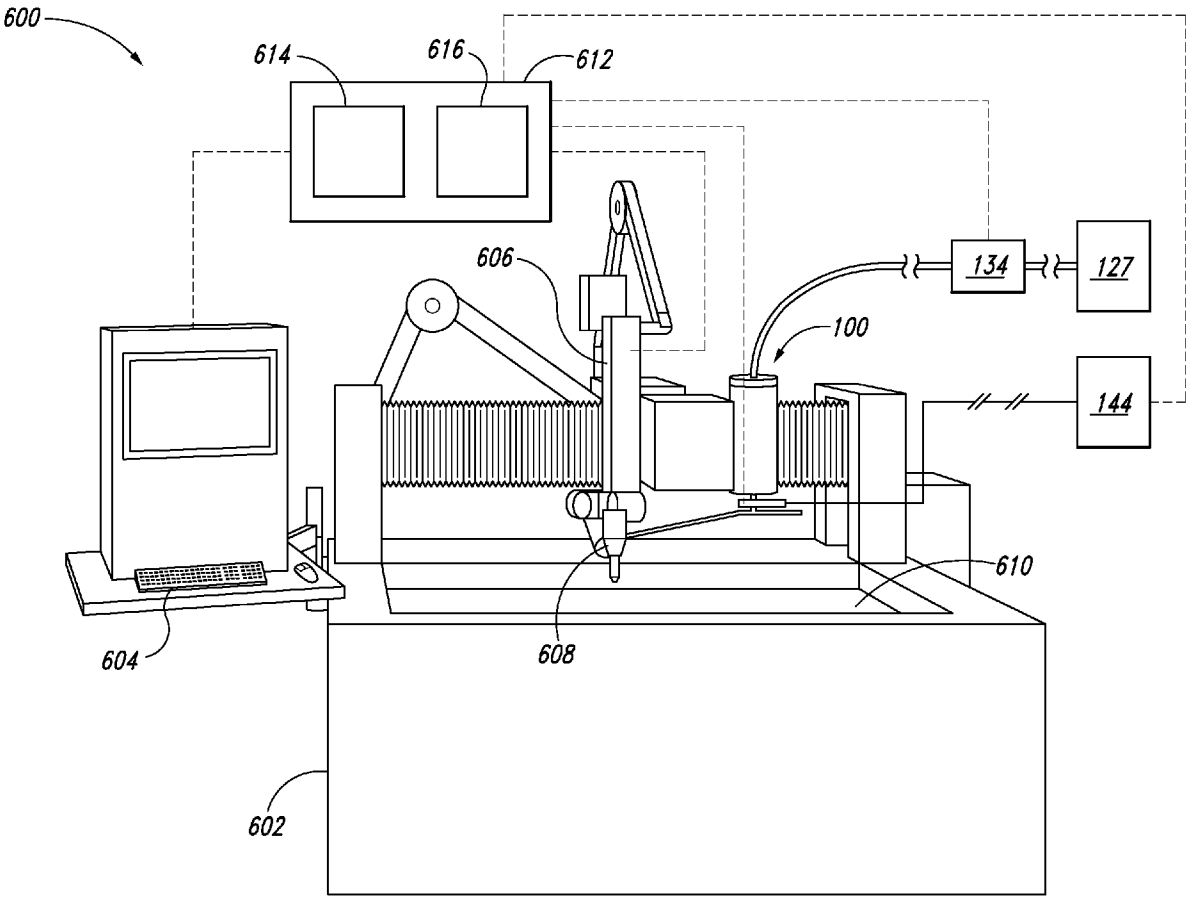
FIG. 6 is a perspective view illustrating an abrasive-jet system including the abrasive-delivery apparatus shown in FIG. 1 configured in accordance with an embodiment of the present technology.

FIG. 6 is a perspective view illustrating an abrasive-jet system 600 including the abrasive-delivery apparatus 100 configured in accordance with an embodiment of the present technology. The system 600 can include a base 602, a user interface 604 supported by the base 602, and an actuator assembly 606 configured to move both a cutting head 608 and the abrasive-delivery apparatus 100 relative to the base 602. For simplicity, FIG. 6 does not show a number of components (e.g., a fluid source, a pump, an intensifier, etc.) that can be included in the system 600 upstream from the cutting head 608. The abrasive-delivery apparatus 100 can be configured to feed particulate abrasive material to the cutting head 608 (e.g., partially or entirely in response to a Venturi effect associated with fluid passing through the cutting head 608). Within the cutting head 608, the particulate abrasive material can accelerate with the jet before being directed toward a workpiece (not shown) held in a jig (also not shown). The base 602 can include a diffusing tray 610 configured to diffuse energy of the jet after it passes through the workpiece. The system 600 can also include a controller 612 (shown schematically) operably connected to the user interface 604, the actuator assembly 606, and the abrasive-delivery apparatus 100 (e.g., at the shutoff valve 142, the pneumatic source 144, and the pump 134). The controller 612 can include a processor 614 and memory 616 and can be programmed with instructions (e.g., non-transitory instructions contained on a computer-readable medium) that, when executed, control operation of the system 600.

Figure 7:
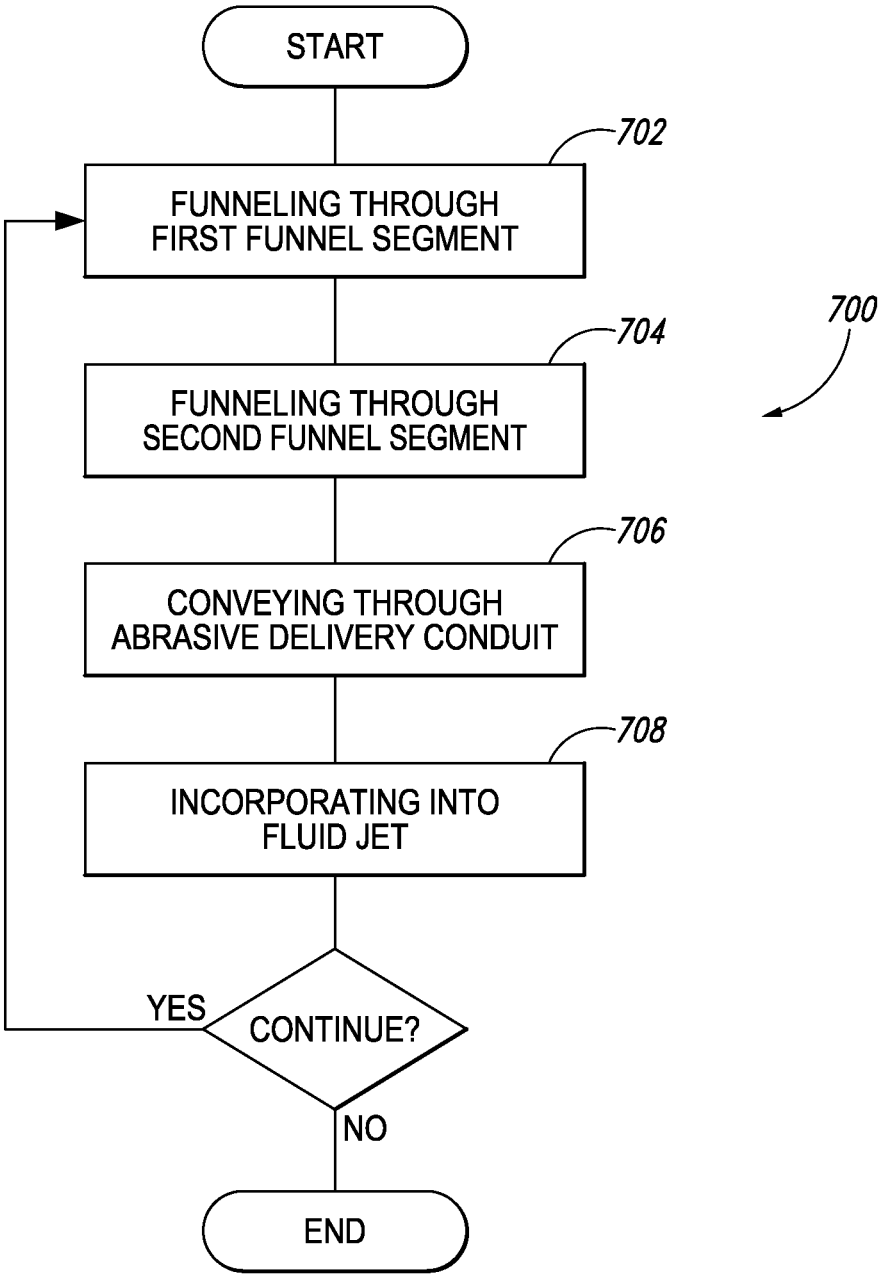
FIG. 7 is a flow chart illustrating a method for delivering particulate abrasive material within the abrasive-jet system shown in FIG. 6 in accordance with an embodiment of the present technology.

FIG. 7 is a flow chart illustrating a method 700 for delivering particulate abrasive material within the abrasive-jet system 600 in accordance with an embodiment of the present technology. With reference to FIGS. 1, 6 and 7 together, the method 700 can include funneling particulate abrasive material (e.g., fine particulate abrasive material) through the first funnel segment 106 (block 702) and then through the second funnel segment 108 (block 704). Next, the particulate abrasive material can be conveyed through the abrasive-delivery conduit 140 from the second funnel segment 108 to the cutting head 608 (block 706). Within the cutting head 608, the particulate abrasive material can be incorporated into a fluid jet (block 708).

The method 700 can also include other suitable operations. As an example, the method 700 can include filtering the particulate abrasive material upstream from the first funnel segment 106. As another example, the method 700 can include collecting static electricity at the interior surface 106*b* of the first funnel segment 106 and/or at the interior surface 108*b* of the second funnel segment 108. The collected static electricity, for example, can be generated by funneling the particulate abrasive material through the first and second funnel segments 106, 108. As another example, the method 700 can include mechanically agitating the first funnel segment 106 while funneling the particulate abrasive material through the first funnel segment 106 and/or mechanically agitating the second funnel segment 108 while funneling the particulate abrasive material through the second funnel segment 108. As another example, the method 700 can include at least partially equilibrating a pressure differential between gas mixed with the particulate abrasive material within the second funnel segment 108 and atmospheric pressure. This can include, for example, venting the gas via the ventilation tube 502. As another example, the method 700 can include stirring the particulate abrasive material within the first funnel segment 106 while funneling the particulate abrasive material through the first funnel segment 106 and/or stirring the particulate abrasive material within the second funnel segment 108 while funneling the particulate abrasive material through the second funnel segment 108, such as by rotating the ventilation tube 502 about its longitudinal axis.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown or described in detail to avoid unnecessarily obscuring the description of the embodiments of the present technology. Although steps of methods may be presented herein in a particular order, in alternative embodiments, the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown or described herein.

Certain aspects of the present technology may take the form of computer-executable instructions, including routines executed by a controller or other data processor. In some embodiments, a controller or other data processor is specifically programmed, configured, or constructed to perform one or more of these computer-executable instructions. Furthermore, some aspects of the present technology may take the form of data (e.g., non-transitory data) stored or distributed on computer-readable media, including magnetic or optically readable or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps.

The methods disclosed herein include and encompass, in addition to methods of making and using the disclosed materials, apparatuses, and systems, methods of instructing others to make and use the disclosed materials, apparatuses, and systems. For example, a method in accordance with a particular embodiment includes funneling particulate abrasive material through a first funnel segment, funneling the particulate abrasive material through a second funnel segment downstream from the first funnel segment, conveying the particulate abrasive material through an abrasive-delivery conduit from the second funnel segment to a cutting head, and incorporating the particulate abrasive material into a fluid jet within the cutting head. A method in accordance with another embodiment includes instructing such a method.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

We claim:

1. An abrasive-jet system, comprising:

an abrasive-delivery apparatus including— a first funnel segment having a first inlet, a first outlet, and a first interior surface extending between the first inlet and the first outlet, wherein the first interior surface has an angle within a range from 7 degrees to 16 degrees relative to vertical axis when the abrasive-delivery apparatus is aligned with the vertical axis, and a second funnel segment downstream from the first funnel segment, the second funnel segment having a second inlet, a second outlet, and a second interior surface extending between the second inlet and the second outlet, wherein the second interior surface has an angle within a range from 2 degrees to 5 degrees relative to the vertical axis when the abrasive-delivery apparatus is aligned with the vertical axis;

a cutting head; and an abrasive-delivery conduit extending between the abrasive-delivery apparatus and the cutting head.

2. The abrasive-jet system of claim 1 wherein the abrasive-delivery apparatus includes a filter upstream from the first funnel segment, the filter being configured to prevent particulate abrasive material having a sieve diameter greater than a threshold sieve diameter from entering the first funnel segment.

3. The abrasive-jet system of claim 2 wherein the threshold sieve diameter is less than 50 microns.

4. The abrasive-jet system of claim 2 wherein the threshold sieve diameter is less than 31 microns.

5. The abrasive-jet system of claim 1 wherein the abrasive-delivery apparatus includes a ventilation tube operably connected to the second funnel segment, the ventilation tube having:

a first opening within the second funnel segment; and a second opening outside of the first and second funnel segments.

6. The abrasive-jet system of claim 5 wherein:

the first and second funnel segments are electrically insulative;

the ventilation tube is electrically conductive; and the ventilation tube is configured to collect static electricity generated by funneling particulate abrasive material through the first and second funnel segments.

7. The abrasive-jet system of claim 5, wherein the abrasive-delivery apparatus includes a metering element detachably connectable to the second funnel segment, the metering element having a third inlet, a third outlet, and a third interior surface extending between the third inlet and the third outlet, wherein the first opening of the ventilation tube is spaced apart from the third inlet by a vertical distance within a range from 5 millimeters to 21 millimeters when the abrasive-delivery apparatus is aligned with the vertical axis and the metering element is detachably connected to the second funnel segment.

8. The abrasive-jet system of claim 5 wherein:

the ventilation tube has a longitudinal axis parallel to the vertical axis when the abrasive-delivery apparatus is aligned with the vertical axis; and the abrasive-delivery apparatus includes a motor operably coupled to the ventilation tube, the motor being configured to rotate the ventilation tube about the longitudinal axis.

9. The abrasive-jet system of claim 8 wherein the ventilation tube includes a projection configured to stir particulate abrasive material within the first funnel segment, the second funnel segment, or both when the ventilation tube is rotated about the longitudinal axis.

10. The abrasive-jet system of claim 1, wherein the abrasive-delivery apparatus includes a metering element detachably connectable to the second funnel segment, the metering element having a third inlet, a third outlet, and a third interior surface extending between the third inlet and the third outlet, a cross-sectional area of the third inlet perpendicular to the vertical axis when the abrasive-delivery apparatus is aligned with the vertical axis being greater than a cross-sectional area of the third outlet perpendicular to the vertical axis when the abrasive-delivery apparatus is aligned with the vertical axis.

11. The abrasive-jet system of claim 10 wherein a ratio of a diameter of the second outlet to a diameter of the third outlet is 3:1 or greater.

12. An abrasive-jet system, comprising:

an abrasive-delivery apparatus including— a first funnel segment having an interior angle within a range from 7 degrees to 16 degrees relative to a vertical axis when the abrasive-delivery apparatus is aligned with the vertical axis, a second funnel segment downstream from the first funnel segment, the second funnel segment having an interior angle within a range from 2 degrees to 5 degrees relative to the vertical axis when the abrasive-delivery apparatus is aligned with the vertical axis, and a metering element detachably connectable to the second funnel segment, the metering element having an interior angle within a range from 4 degrees to 12 degrees relative to the vertical axis when the abrasive-delivery apparatus is aligned with the vertical axis and the metering element is detachably connected to the second funnel segment;

a cutting head; and an abrasive-delivery conduit extending between the abrasive-delivery apparatus and the cutting head.

* * * * *